US006551119B1

(12) United States Patent
Sakamoto et al.

(10) Patent No.: US 6,551,119 B1
(45) Date of Patent: Apr. 22, 2003

(54) SPLICE ABSORBING STRUCTURE

(75) Inventors: Masami Sakamoto, Shizuoka (JP); Yutaka Matsuoka, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/516,943

(22) Filed: Mar. 1, 2000

(30) Foreign Application Priority Data

Mar. 1, 1999 (JP) ..... 11-053290

(51) Int. Cl.[7] ..... H01R 13/28
(52) U.S. Cl. ..... 439/287; 439/701
(58) Field of Search ..... 439/287, 594, 439/596, 701, 717, 907, 507, 189, 288

(56) References Cited

U.S. PATENT DOCUMENTS

| | | | | |
|---|---|---|---|---|
| 5,122,077 A | * | 6/1992 | Maejima et al. | 439/717 |
| 5,314,350 A | * | 5/1994 | Matthews et al. | 439/717 |
| 5,501,605 A | | 3/1996 | Ozaki et al. | 439/34 |
| 5,575,674 A | * | 11/1996 | Davis et al. | 439/288 |
| 5,988,511 A | * | 11/1999 | Schmidt et al. | 439/717 |
| 5,997,362 A | * | 12/1999 | Hatagishi et al. | 439/717 |

FOREIGN PATENT DOCUMENTS

| | | | |
|---|---|---|---|
| DE | 44 07 083 A1 | 9/1994 | H01R/31/08 |
| EP | 0 548 942 A1 | 6/1993 | H01R/13/514 |
| JP | 48-30784 | 4/1973 | |
| JP | 48-30785 | 4/1973 | |
| JP | 49-52091 | 5/1974 | |
| JP | 4-115785 | 10/1992 | H01R/23/68 |
| JP | 5-60984 | 8/1993 | H01R/23/02 |
| JP | 7-326447 | 12/1995 | H01R/31/08 |
| JP | 8-222291 | 8/1996 | H01R/9/07 |

* cited by examiner

*Primary Examiner*—Hien Vu
(74) *Attorney, Agent, or Firm*—Sughrue Mion, PLLC

(57) ABSTRACT

There are provided blocks (A), (B), . . . corresponding to pieces of sub-harness (A), (B), . . . . In each block, there are provided a longitudinal opening 14 and a bottom opening 16, which are arranged in the vertical direction, at a forward end portion of each accommodating chamber 11 for accommodating the spring contact point 23*a* of the connecting terminal 20(A), 20(B), . . . . When the blocks are put on each other in the vertical direction, the top 23*a* of the spring contact point 23 on the lower block 10(A) side gets into the bottom opening of the upper block 10(B) from the longitudinal opening 14. Therefore, the top 23*a* of the spring contact point 23 on the lower block 10(A) side comes into contact with the rear face of the base piece 23*b* of the spring contact point 23 on the upper block so that electrical continuity can be attained. Due to the foregoing, the splice between the pieces of subharness (A) and (B) can be absorbed.

10 Claims, 7 Drawing Sheets

SPLICE ABSORBING STRUCTURE

BACKGROUND OF INVENTION

1. Field of Invention

The present invention relates to a structure for absorbing a joint (splice) created in a branch section when electrical signals are distributed and picked up by distributing electrical wires which are made to branch from electrical wires or a piece of wire harness.

2. Related Art

Recently, there has been a tendency that the structure of electrical wires for signal use and pieces of wire harness for automobile use becomes more complicated in accordance with the progress of electronic control. Therefore, for example, as shown in FIG. 8, a plurality of pieces of sub-harness (A), (B), (C), . . . are made to branch from a plurality of positions of one piece of wire harness 1. Each piece of sub-harness is composed of distributing wires 2. A joint connector 3, which will be referred to as J/C in this specification hereinafter, arranged at the end portions of the distributing electrical wires 2 is connected with a joint box, which will be referred to as J/B in this specification hereinafter, which is an electrical connection box and also connected with other devices mounted on an automobile, so that electrical continuity can be attained for transmitting electrical signals.

In the above description, it is described that a plurality of pieces of sub-harness (A), (B), (C), . . . are made to branch from one piece of wire harness 1. However, the piece of wire harness 1 is actually produced in such a manner that the pieces of sub-harness (A), (B), (C), . . . are previously produced separately and jointed to each other into one piece of wire harness 1 in the latter production process.

FIG. 9 is a view schematically showing the wire harness illustrated in FIG. 8. In the case where the splices of the branch sections of the distributing electrical wires 2 in the pieces of sub-harness (A), (B), (C), . . . are absorbed, an electrical connection box such as J/B is commonly used. However, the following problems may be encountered in the actual condition. When the number of the branch sections is large and J/B is used for absorbing the splices of all the branches, the number of the distributing electrical wires 2 is much increased, so that the electrical circuit 2*a* in J/B becomes more complicated. As a result, the size of J/B itself is increased. Therefore, in the case of an automobile, the accommodating space of which is strictly limited, the costs of parts are raised due to the increase in the size of J/B, which is disadvantageous in all aspects. The degree of freedom of changing the design of the circuit is low in the case of the splice absorbing structure in which J/B is used. Accordingly, the productivity of the wire harness is deteriorated. As a result, the production cost is raised.

The simplest way to solve the above problems is to absorb the splice of the branch of the distributing electrical wires 2 without using J/B and J/C.

FIGS. 10A and 10B are views showing an electrical connector disclosed in Unexamined Utility Model Publication Sho.48-30785 which is proposed according to the above concept. In this case, the insulating box 4 is used instead of J/B and J/C, and the connecting terminals 6 are press-fitted into the square grooves 5 provided inside the insulating box 4. Due to the foregoing, the connecting terminals 6, which are adjacent to each other, are connected to each other with pressure, so that the splices can be absorbed and electrical continuity can be attained.

According to the splice absorbing connector disclosed in Unexamined Japanese Patent Publication Hei. 8-22859, there are used terminal insertion holes, which have not been used yet, out of a large number of terminal insertion holes provided in the existing J/B housing, and also there is used a bus bar of the fuse retainer. As a result, no specific J/C for absorbing the splice is used in the branch section, and the splice can be absorbed by using the existing J/B. Due to the above arrangement, the number of electrical wires can be reduced.

However, according to the related art disclosed in the above two patent publications, only the splices between the distributing electrical wires 2 of the pieces of sub-harness (A), (B), (C), . . . shown in FIG. 8 are absorbed, that is, consideration is not given to the absorption of the splice between one sub-harness and another sub-harness.

SUMMARY OF INVENTION

Therefore, it is an object of the present invention to provide a splice absorbing structure effective for reducing the number of electrical wires in a circuit and enhancing the productivity of the wire harness by absorbing the splice between the distributing wires and also the splice between the pieces of sub-harness without using J/B and J/C which are conventionally used for absorbing the splice of the electrical wires at the branch.

According to the first aspect of the present invention, there is provided a splice absorbing structure in which a plurality of pieces of sub-harness for distributing and picking up electrical signals from a piece of wire harness are made to branch, the pieces of sub-harness are respectively composed of a plurality of distributing electrical wires and splices of the distributing electrical wires at the branch section are absorbed, comprising: a connecting terminal crimped to an end portion of the distributing electrical wire at the branch section of the sub-harness, having a contact point elastic piece at the end portion; and a plurality of blocks, the number of which corresponds to the number of the pieces of sub-harness, capable of being engaged with and put on each other, having a plurality of terminal accommodating chambers arranged in parallel for accommodating the connecting terminals, wherein when the plurality of blocks are put on each other, the contact point elastic piece of the connecting terminal of the piece of sub-harness on one side comes into contact with the corresponding contact point elastic piece of the connecting terminal of the piece of sub-harness on the other side so that electrical continuity can be accomplished.

Due to the above structure, when the blocks corresponding to a plurality of pieces of sub-harness are put on each other, the connecting terminals accommodated in the blocks, which correspond to each other, come into contact with each other, so that the connecting terminals are electrically communicated with each other. In this way, the splice between the pieces of sub-harness can be absorbed, or the splice between a plurality of distributing electrical wires of one piece of sub-harness can be absorbed.

According to the second aspect of the present invention, there is provided a splice absorbing structure in which the block has a longitudinal opening and a bottom opening at the forward end of the terminal accommodating chamber for accommodating the contact point elastic piece of the connecting terminal, a top of the contact point elastic piece is engaged with the bottom opening on the other block side from the longitudinal opening when the blocks are put on each other, so that the top of the contact point elastic piece comes into contact with a base portion of the other contact point elastic piece, and a splice between one piece of sub-harness and the other piece of sub-harness can be absorbed.

In this case, since the longitudinal opening and the bottom opening are formed in the terminal accommodating chamber of each block, when the blocks are put on each other, the connecting terminals of the pieces of sub-harness accommodated in the lower block come into contact with the corresponding connecting terminals of the pieces of sub-harness accommodated in the upper block. Due to the foregoing, the splice between the pieces of sub-harness can be absorbed.

According to the third aspect of the present invention, there is provided a splice absorbing structure in which a lateral opening for communicating an end of one terminal accommodating chamber with an end of the other terminal accommodating chamber, which is adjacent to one terminal accommodating chamber, is formed in one of the blocks, and when the connecting terminal is accommodated in each terminal accommodating chamber under the condition that the contact point elastic piece is turned sideways, a top of one connecting terminal comes into contact with a base piece of the other connecting terminal via the lateral opening, so that a splice between one distributing electrical wire and the other distributing electrical wire, which is adjacent to one distributing electrical wire, can be absorbed.

In this case, in each block, there is provided a lateral opening for communicating the terminal accommodating chambers adjacent to each other. Therefore, for example, when the connecting terminals of the sub-harness are accommodated in one block under the condition that the contact point elastic pieces of the connecting terminals are turned sideways, the contact point elastic pieces come into contact with each other. Due to the foregoing, the splices between a plurality of distributing electrical wires of one piece of sub-harness can be absorbed.

According to the fourth aspect of the present invention, there is provided a splice absorbing structure in which the blocks, which are integrated into one body by being put on each other, are directly connected with other devices including a joint box, so that electrical continuity can be accomplished.

In this case, when a body in which the blocks are put on each other and integrated is directly connected with other devices, the splices can be collectively absorbed outside the joint box. Therefore, the circuit in the joint box can be reduced and simplified, and an increase in the size of the box can be prevented.

According to the fifth aspect of the present invention, there is provided a splice absorbing structure in which the uppermost block out of the blocks integrated into one body by being put on each other also functions as a cover of the longitudinal opening provided at the end of the terminal accommodating chamber, and a contact point elastic piece of the connecting terminal, which is accommodated in the terminal accommodating chamber, is a female terminal.

In this case, when the uppermost block is also used as a cover, the contact point elastic pieces of the connecting terminals accommodated in the block can be made to be female terminals. Therefore, when the male terminals such as rod-shaped tabs are inserted into the female terminals from the outside of the block so as to attain electrical continuity, the direct connecting structure to other devices such as the joint box can be effectively attained.

DETAILED DESCRIPTION OF PREFERRED EMBODIMENTS

Referring to FIGS. 1 to 7, an embodiment of the splice absorbing structure of the present invention will be explained below in detail.

Figure 1:
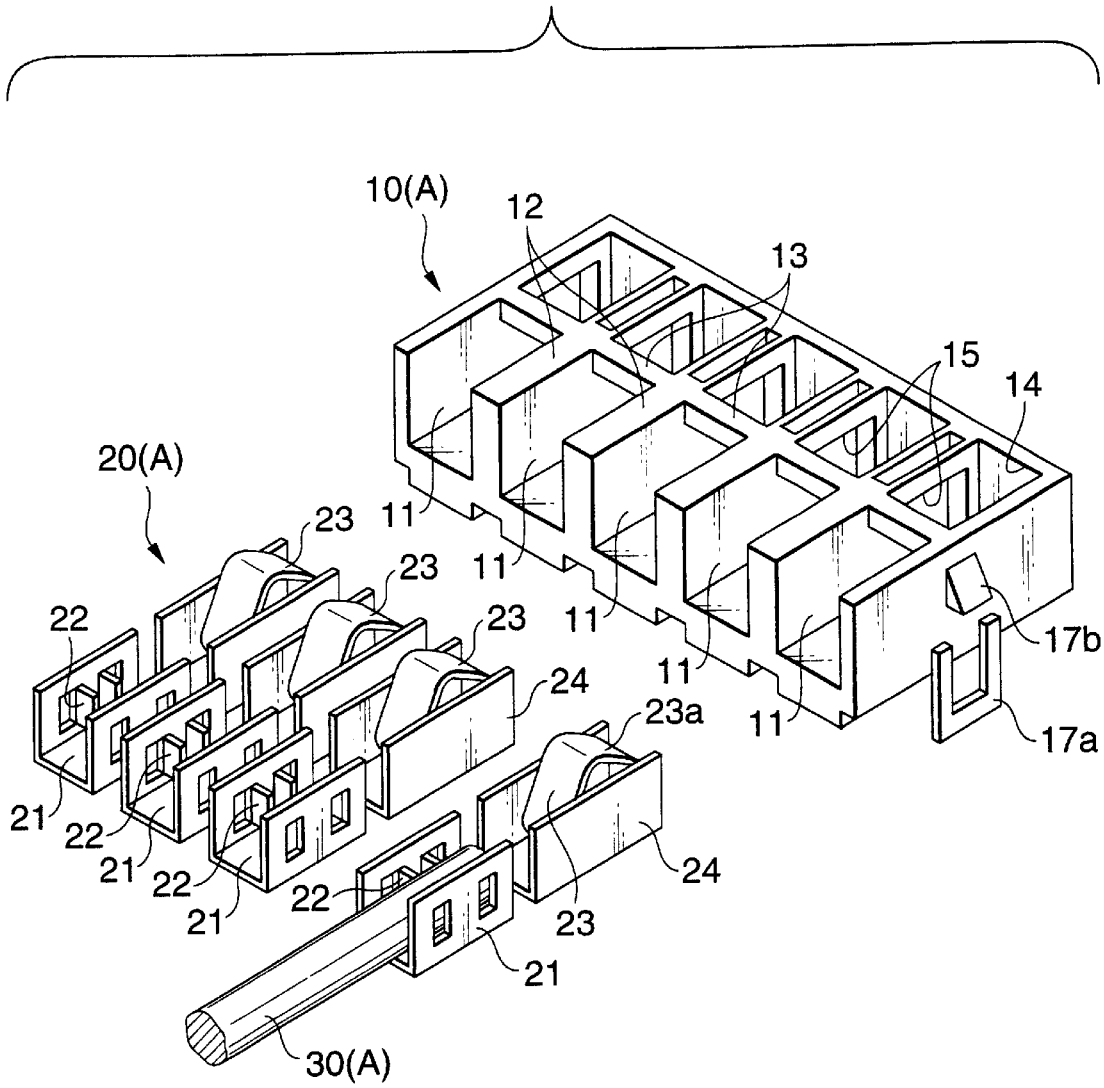
FIG. 1 is an exploded perspective view showing the first embodiment of the splice absorbing structure of the present invention.

FIGS. 1 to 4 are views showing a splice absorbing structure of the first embodiment. As shown in FIG. 1, there is provided a terminal accommodating block 10 which is a primary portion of the splice absorbing structure. As shown in the drawing, in the block 10, there are provided a plurality of accommodating chambers 11, which are arranged in a row, for accommodating a plurality of connecting terminals 20 when this block 10 is partitioned by the partition walls 12 as shown in the drawing.

As shown in the drawing, the connecting terminal 20, includes an electrical wire crimping section 21, the section of which is formed into C-shape, into which the biting claw 22 is protruded. An end portion of the electrical wire 30 is bitten by the biting claw 22, so that the electrical wire 30 can be crimped to the connecting terminal 20 with pressure. In this case, the electrical wire 30 means a plurality of distributing electrical wires for picking up electrical signals composed of the pieces of each sub-harness (A), (B), (C), . . . shown in FIG. 8. The connecting terminal 20 includes a spring contact point section (contact point elastic piece) 23 which is formed in such a manner that a bottom plate of the electrical wire crimping section 21 extends forward and bent into an angular shape. Both sides of this spring contact point section are formed into the spring case walls 24 which are raised being formed in a C-shaped section. The top 23*a* of the spring contact point section 23 is protruded from the spring case wall 24 and elastically contacted with other terminal so as to attain electrical continuity.

Concerning the distributing electrical wire 30, in the sub-harness assembling process, the distributing electrical wire 30 is previously attached to the electrical wire crimping section 21 of the connecting terminal 20 with pressure. After that, the connecting terminal 20 is accommodated into the corresponding accommodating chamber 11 of the block 10, so that the connecting terminal 20 can be incorporated into the block 10. Alternatively, the end portion of the distributing electrical wire 30 may be crimped to the electrical wire crimping section 21 with pressure of the connecting terminal 20 which has been previously incorporated into the accommodating chamber 11.

Figure 2A:
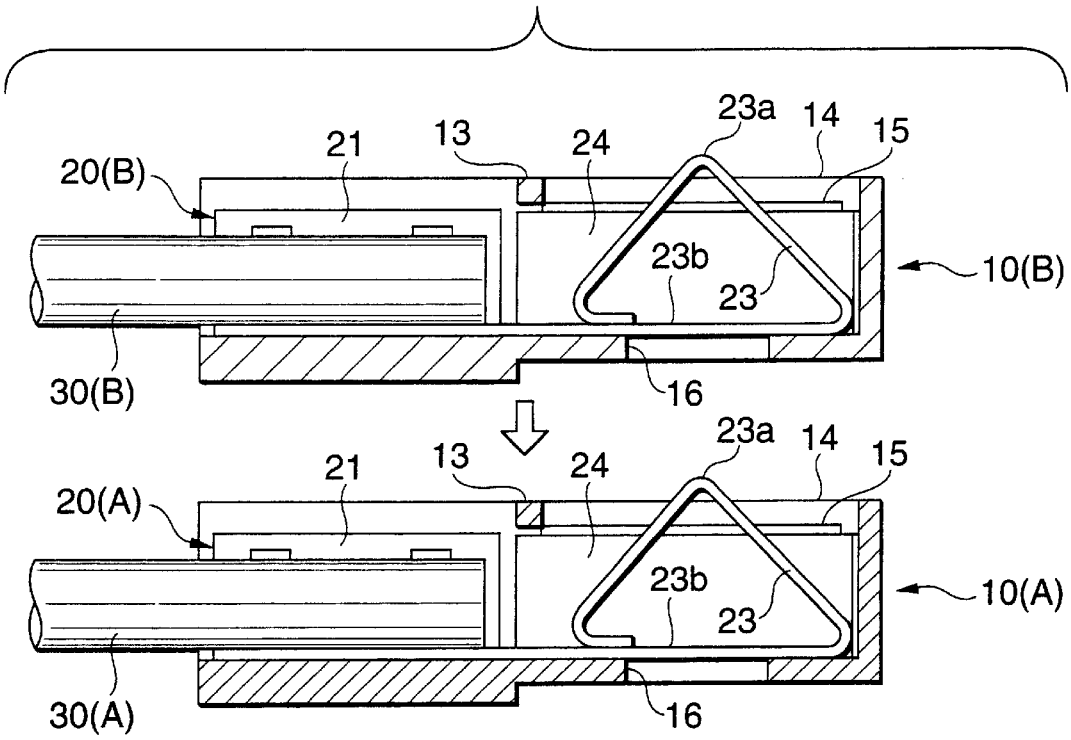
FIG. 2A is a cross-sectional side view showing a state of the first embodiment before the blocks corresponding to a plurality of pieces of sub-harness are put on and integrated into one body.
Figure 2B:
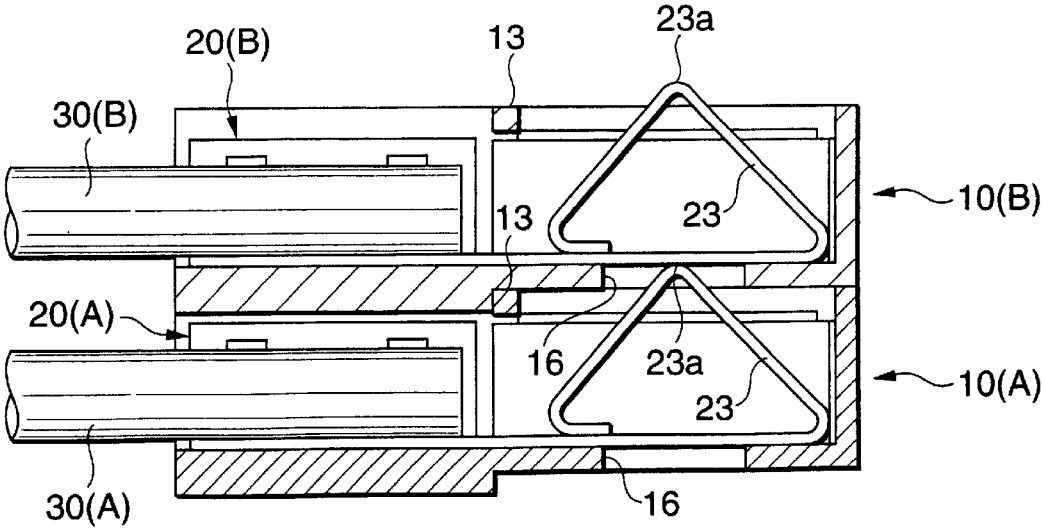
FIG. 2B is a cross-sectional side view showing a state of the first embodiment after the blocks corresponding to a plurality of pieces of sub-harness have been put on and integrated into one body.

The structure of the block 10 will be shown here in detail in reference to the profile of the connecting terminal 20. As shown in FIGS. 1, 2A and 2B, each accommodating chamber 11 is composed of the first half section and the second half section which are formed when the accommodating chamber 11 is divided by the horizontal beam section 13 in the inserting direction of the connecting terminals 20. The spring contact point section 23 of the connecting terminal 20 is accommodated in the first half section, and the electrical wire crimping section 21 is accommodated in the second half section. A lower portion of the horizontal beam 13 is an open space. From this open space, the spring contact point 23 of the connecting terminal 20 can be inserted into the first half section of the accommodating chamber while the spring contact point 23 is being elastically deformed and bent. An upper portion of the first half section of the accommodating chamber is a longitudinal opening 14 which is formed open. After the top 23*a* of the spring contact point 23 has been inserted into the accommodating chamber, it protrudes from the longitudinal opening 14. The lateral opening 15 is formed on the partition wall 12 of the adjacent accommodating chamber 11. Further, the bottom opening 16 is formed on the bottom plate in the lower portion. As shown in FIGS. 2A and 2B, the base piece 23*b* of the spring contact point 23 is exposed outside from the bottom opening 16 after insertion.

Next, the assembling procedure and the splice absorbing action will be explained for the first embodiment.

Figure 8:
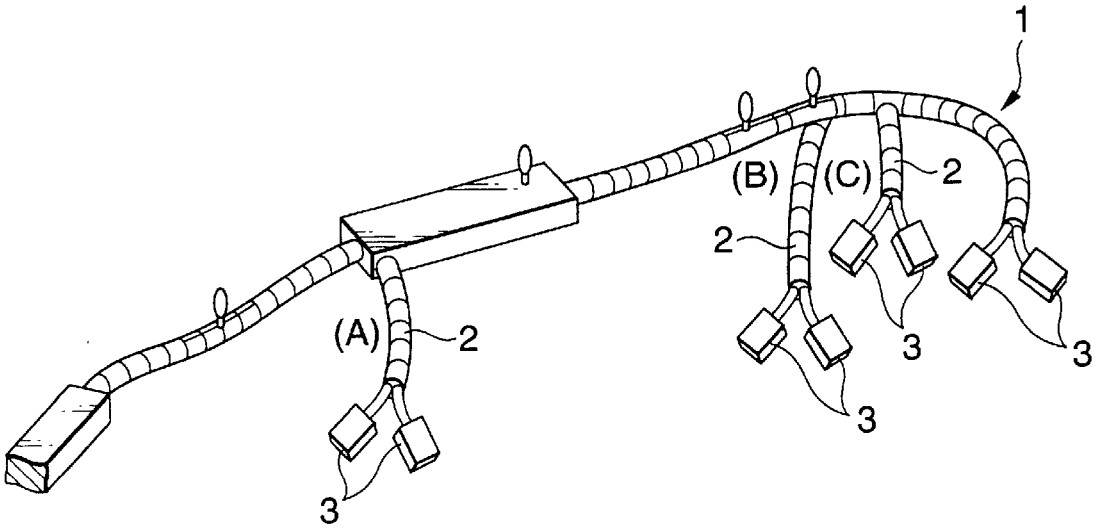
FIG.8 PRIOR ART
FIG. 8 is a perspective view showing a conventional example of the arrangement in which a plurality of pieces of sub-harness (A), (B), (C) branch from one piece of wire harness.

First, in the structure shown in FIG. 8 in which a plurality of pieces of sub-harness (A), (B), (C), . . . branch from the wire harness 1 and the splices between the pieces of sub-harness are absorbed, for example, when the distributing electrical wire 30(A) composing one sub-harness (A) is composed of a plurality of electrical wires as shown in FIG. 1, one block 10(A) is prepared for this sub-harness (A).

The distributing electrical wire 30(A) is incorporated into each accommodating chamber 11 of the block 10(A) via the connecting terminal 20(A). In this case, an end portion of the distributing wire 30(A) is previously crimped to the connecting terminal 20(A) with pressure, and the connecting terminal is inserted and incorporated into the corresponding accommodating chamber 11.

Next, as shown in FIG. 2A, the distributing electrical wire 30(B) composing another piece of sub-harness (B) is previously accommodated and incorporated into the block 10(B). This block 10(B) is put on an upper portion of the block 10(A) of the sub-harness (A).

As shown in FIG. 2B, in the two blocks 10(A) and 10(B) which are put on each other, the top 23*a* of the spring contact point 23 on the lower block 10(A) side gets into the bottom opening 16 of the upper block (B). Due to the foregoing, the top 23*a* on the lower side comes into elastic contact with the rear face of the base piece 23*b* of the spring contact point 23 of the upper connecting terminal 20(B) which is exposed from the bottom opening 16.

That is, the distributing electrical wire 30(A) on the block 10(A) side and the distributing electrical wire 30(B) on the block 10(B) side, which corresponds to the distributing electrical wire 30(A), come into contact with each other being electrically communicated with each other. Due to the foregoing, the splice between the two pieces of sub-harness (A) and (B) is collectively absorbed by the integrated blocks 10(A) and 10(B).

In this connection, in order to integrally combine the two blocks 10(A) and 10(B) with each other, there are provided a pair of locking recess 17*a* and locking protrusion 17*b*, which can be quickly engaged with each other, on the side wall of each block as shown in FIG. 1.

Figure 3:
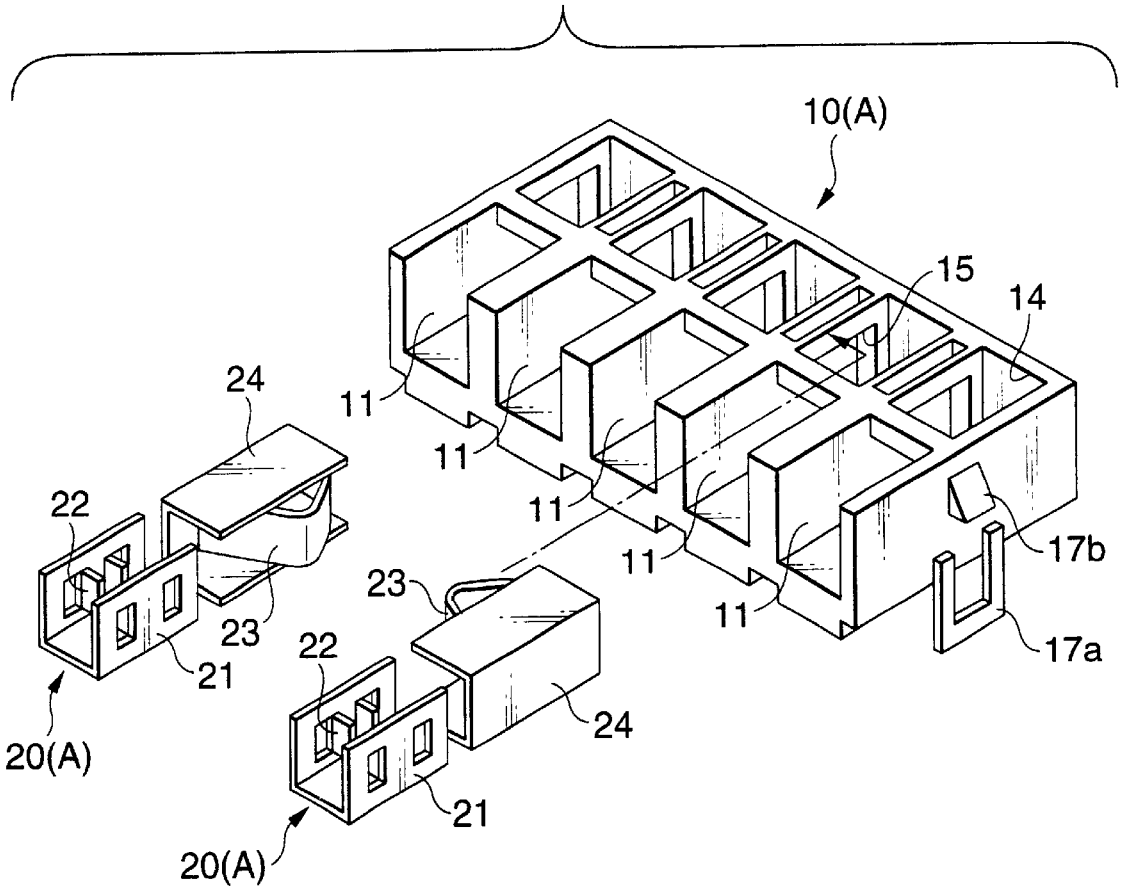
FIG. 3 is an exploded perspective view showing the first embodiment of the splice absorbing structure in the case of absorbing the splice between a plurality of distributing electrical wires of one piece of sub-harness.
Figure 4:
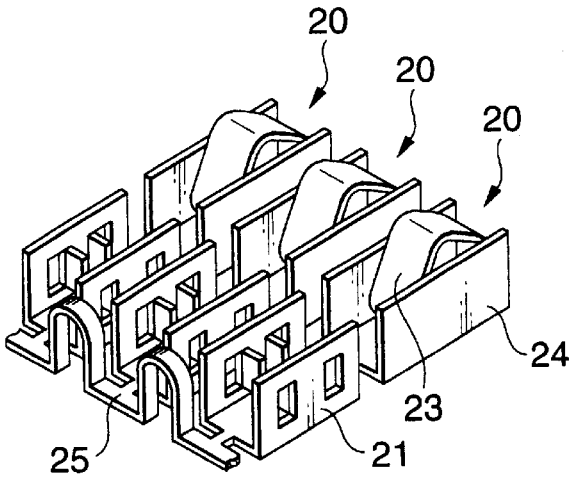
FIG. 4 is a perspective view showing connecting terminals which are connected with each other by the margin portions used for feeding the material in the process of press punching.

FIG. 3 is a view showing a case in which the splice between a plurality of distributing electrical wires (A) forming one of the pieces of sub-harness (A) is absorbed.

The connecting terminal 20(A), to which the distributing electrical wire 30(A) is crimped with pressure, is inserted into each accommodating chamber 11 of the block (A) while the spring contact point 23 is turned sideways in an arbitrary direction. The top 23*a* of the spring contact point 23, which has been set being turned sideways, gets into the lateral opening 15 formed on the partition wall 12 of the first half section of the accommodating chamber 11 of the block 10(A). Therefore, the top 23*a* of the spring contact point 23 comes into contact with the rear face of the base piece 23*b* of the spring contact 23 of the connecting terminal 20(A) of the adjacent accommodating chamber 11. Therefore, electrical continuity can be attained. In this way, the splice between the distributing electrical wires can be absorbed in one piece of sub-harness.

In this case, the entire connecting terminal 20(A) may be set as it is being turned sideways. Alternatively, as shown in FIG. 3, the spring contact point 23 is turned by 90° and set sideways together with the spring case wall 24 with respect to the C-shaped electrical wire crimping section 21 which is set upward.

In this connection, in the case where the splice between the distributing electrical wires is absorbed, it is possible to leave the margin section 25 as it is which is estimated to be used for feeding the material in the process of mass production of the connecting terminals 20(A) by press punching, and the connecting terminals 20(A) may be inserted into the accommodating chambers 11 of the block 10(A) under the condition that the connecting terminals 20(A) are connected with each other. In this case, when the margin section 25 is formed into an arch-shape, an interval of the connecting terminals 20(A) can be made to agree with the pitch of the accommodating chambers 11 by contracting the arch-shaped portion. Absorption of the splice between the connecting terminals 20(A), which are adjacent to each other in the direction of a lateral row, can be freely set by whether or not the margin section 25 is left being cut. Of course, the connecting terminals 20(A) may be separated and used as a single body.

As can be seen in the above explanations, it becomes unnecessary to provide the joint connector 3 which is required for each piece of sub-harness (A), (B), (C), . . .

illustrated in FIG. 8. Further, it becomes unnecessary to provide J/B. Accordingly, the costs of parts can be greatly reduced, and the productivity of the wire harness can be remarkably enhanced.

Figure 5:
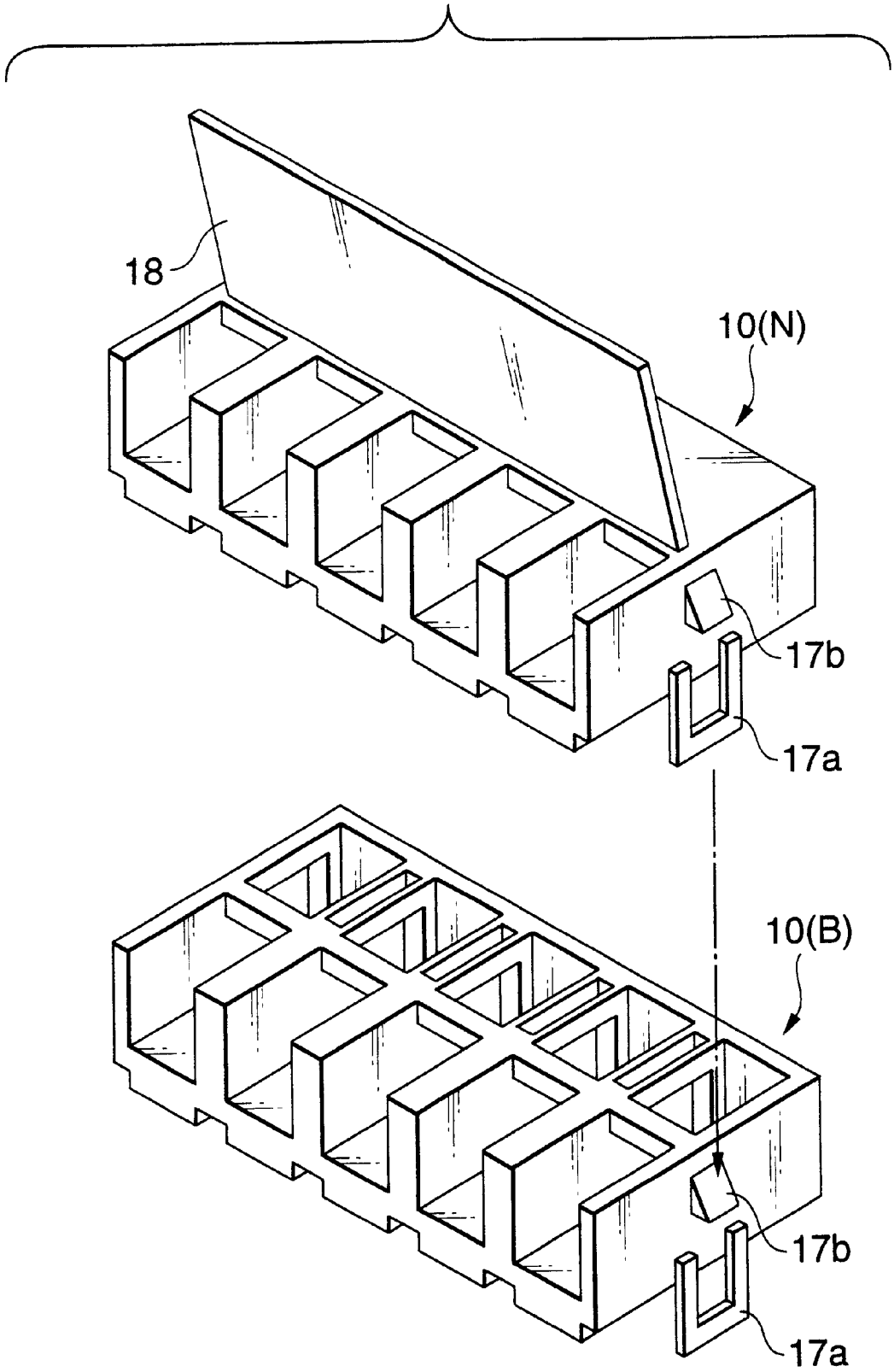
FIG. 5 is an exploded perspective view showing the second embodiment of the splice absorbing structure of the present invention preferably used when it is directly connected with an existing device.
Figure 6:
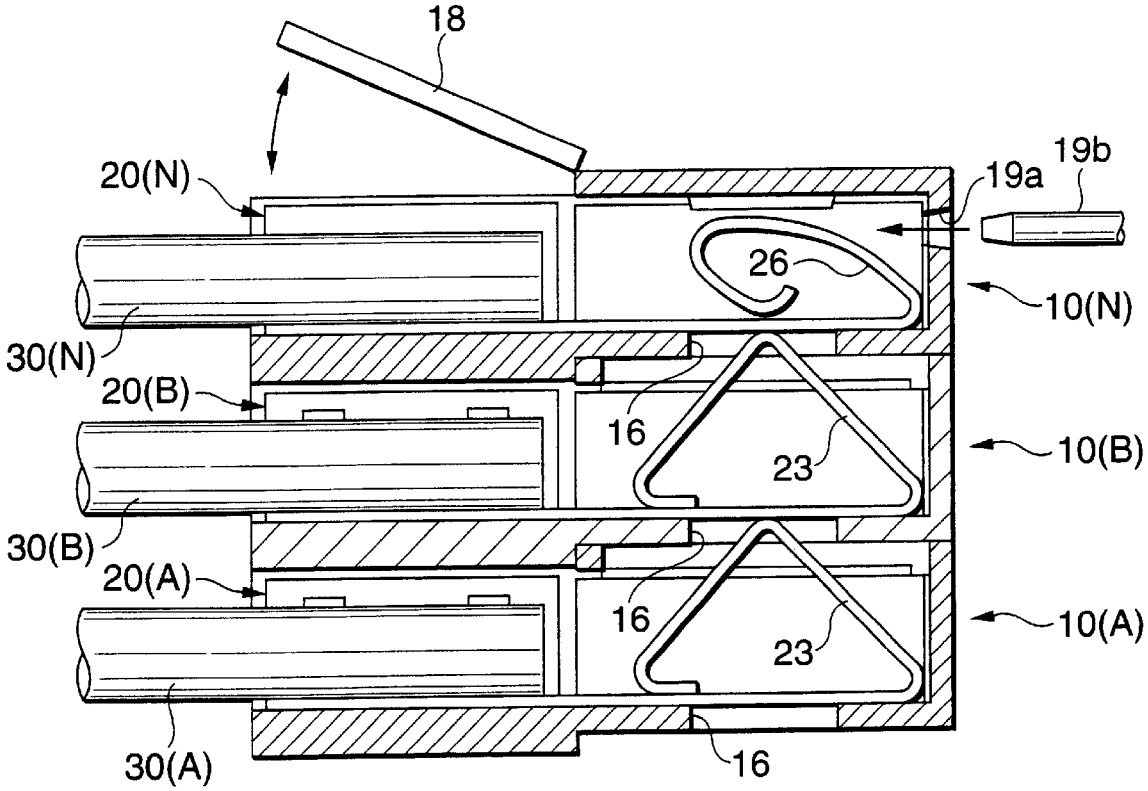
FIG. 6 is a cross-sectional side view showing a state in which the blocks corresponding to a plurality of pieces of sub-harness are put on and integrated with each other in the vertical direction in the second embodiment.

Next, FIGS. 5 and 6 are views showing a splice absorbing structure of the second embodiment of the present invention.

This splice absorbing structure is composed as follows. After the blocks 10(A), 10(B), . . . used for the pieces of sub-harness (A), (B), . . . have been put on each other, the block 10(N), which is also used as a cover case, is joined to the uppermost block 10(B). The block 10(N) is provided with a protective cover 18 which can be freely opened and closed. As shown in FIG. 6, the connecting terminal 20(N) having a spring contact point 26 used as a female type terminal (recessed terminal) is accommodated in the block 10(N). In order to prepare for the connection with this female type connector 20(N), a tab hole 19*a* is formed on the rear wall of the block 10(N). This tab hole 19*a* penetrates the rear wall of the block 10(N). A male tab (protruding tab) 19*b* arranged in the existing J/B not shown in the drawing is inserted from the tab hole 19*a* and elastically contacted with the spring contact point 26 of the female type terminal, so that electrical continuity can be attained.

Concerning the first and the second embodiment described above, it is possible to use the first embodiment as a splice absorbing structure directly connected with a device, however, the second embodiment is most appropriately used as a splice absorbing structure directly connected with a device such as an existing J/B.

Figure 7:
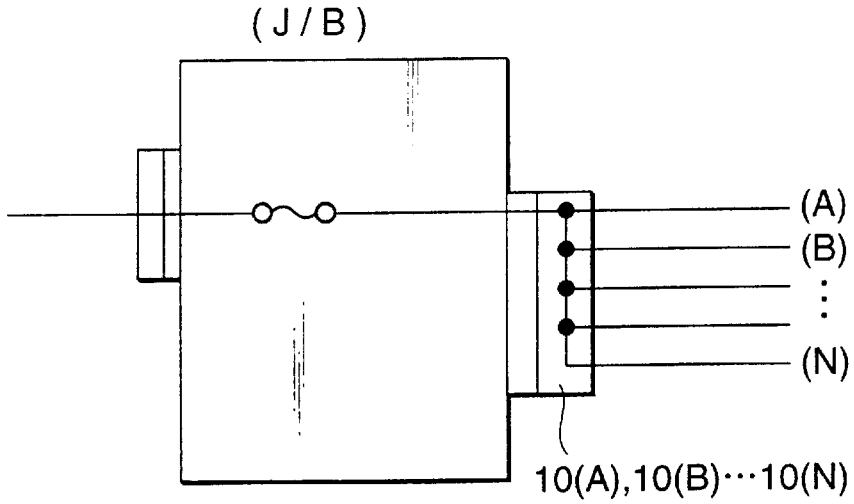
FIG. 7 is a block diagram schematically showing a circuit after the connection of J/B in the second embodiment shown in FIG. 6.
Figure 9:
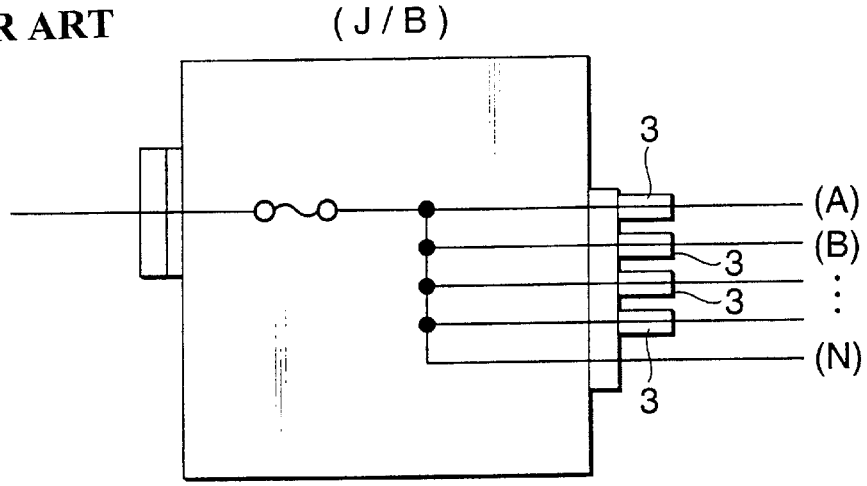
FIG.9 PRIOR ART
FIG. 9 is a block diagram schematically showing a circuit after the wire harness of the conventional example shown in FIG. 8 has been connected with J/B.
Figure 10A:
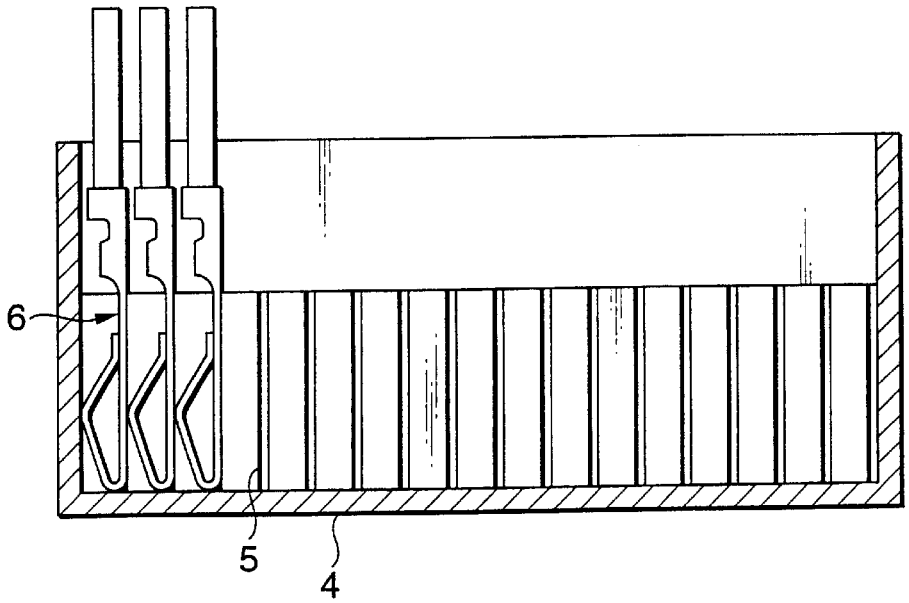
FIG.10(A) PRIOR ART
FIG. 10A is a cross-sectional side view showing a splice absorbing structure of the conventional example.
Figure 10B:
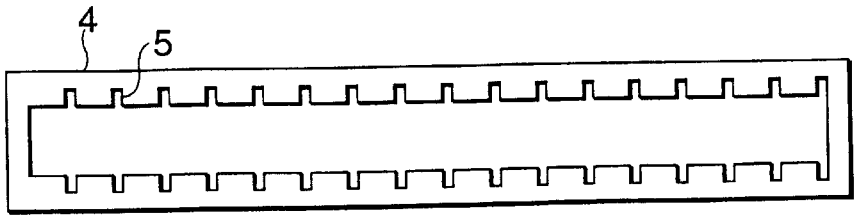
FIG.10(B) PRIOR ART
FIG. 10B is a plan view showing a splice absorbing structure of the conventional example.

As shown in the schematic drawing of FIG. 7, several upper and lower blocks 10(A), 10(B) including the block 10(N) also used as a cover case, into which the connecting terminal 20 has already been incorporated, are integrated into one body and directly connected with the existing J/B. Due to the above arrangement, the circuit in J/B can be simplified, and it becomes possible to suppress an increase in the size of the casing of J/B compared with the conventional arrangement shown in FIG. 9.

As explained above, the splice absorbing structure of the present invention is composed in such a manner that the blocks, the number of which corresponds to the number of a plurality of pieces of sub-harness, are put on each other. Due to the above arrangement, the corresponding connecting terminals accommodated in the blocks come into contact with each other, so that the connecting terminals can be electrically continued to each other. Therefore, it is possible to absorb the splice between the pieces of sub-harness, and it is also possible to absorb the splices among a plurality of distributing electrical wires of one piece of sub-harness. The thus obtained integrated block can be directly connected with other device such as J/B. In this case, the internal circuit of J/b can be simplified. Therefore, it is effective to suppress an increase in the size of J/B itself.

What is claimed is:

1. A splice absorbing structure comprising:

a plurality of sub-harnesses for distributing and picking up electrical signals from a wire harness, said sub-harnesses branching off the wire harness, each of said sub-harnesses having a plurality of electric wires and a branch section for absorbing splices of the electrical wires, said branch section including:

a plurality of connecting terminals respectively crimped to an end portion of the electrical wire at the branch section of the sub-harness, each of said connecting terminals having a contact point elastic piece at an end portion thereof; and a plurality of blocks, the number of which corresponds to the number of sub-harnesses, capable of being engaged with and stack on each other, having a plurality of terminal accommodating chambers arranged in parallel for accommodating the connecting terminals, wherein when the plurality of blocks are stacked on each other, the contact point elastic piece of the connecting terminal of one sub-harness on one side contacts the corresponding contact point elastic piece of the connecting terminal of an adjacent sub-harness so that electrical continuity can be accomplished therebetween, and said plurality of blocks are configured to be attached and detached from each other in a direction perpendicular to a plane containing said accommodating chambers.

2. A splice absorbing structure according to claim 1, wherein the blocks defined by stacking a plurality of the blocks are directly connected with other devices so that electrical continuity can be accomplished.

3. A splice absorbing structure according to claim 2, wherein an uppermost block out of the stacked blocks serves as a cover of the longitudinal opening provided at the end of the terminal accommodating chamber, and said contact point elastic piece of the connecting terminal, which is accommodated in the terminal accommodating chamber, is a female terminal.

4. The structure according to claim 1, wherein each of the plurality of connecting terminals is provided with an electrical wire crimping section for crimping the electric wire.

5. A splice absorbing structure comprising:

a plurality of sub-harnesses for distributing and picking up electrical signals from a wire harness, said sub-harnesses branching off the wire harness, each of said sub-harnesses having a plurality of electric wires and a branch section for absorbing splices of the electrical wires, said branch section including:

a plurality of connecting terminals respectively crimped to an end portion of the electrical wire at the branch section of the sub-harness, each of said connecting terminals having a contact point elastic piece at an end portion thereof, and a plurality of blocks, the number of which corresponds to the number of sub-harnesses, capable of being engaged with and stack on each other, having a plurality of terminal accommodating chambers arranged in parallel for accommodating the connecting terminals, wherein when the plurality of blocks are stacked on each other, the contact point elastic piece of the connecting terminal of one sub-harness on one side contacts the corresponding contact point elastic piece of the connecting terminal of an adjacent sub-harness so that electrical continuity can be accomplished therebetween; and the block has a longitudinal opening and a bottom opening at the tip end of the terminal accommodating chamber for accommodating the contact point elastic piece of the connecting terminal, a vertex of the contact point elastic piece is engaged with the bottom opening on the other block from the longitudinal opening when the blocks are stacked on each other, so that the top of the contact point elastic piece comes into contact with a base portion of the other contact point elastic piece to absorb a splice between one piece of sub-harness and the other piece of sub-harness.

6. A splice absorbing structure according to claim 5, wherein the blocks defined by staking a plurality of the blocks are directly connected with other devices including a joint box so that electrical continuity can be accomplished.

7. A splice absorbing structure according to claim 6, wherein an uppermost block out of the stacked blocks serves as a cover of the longitudinal opening provided at the end of the terminal accommodating chamber, and said contact point elastic piece of the connecting terminal, which is accommodated in the terminal accommodating chamber, is a female terminal.

8. A splice absorbing structure comprising:

a plurality of sub-harnesses for distributing and picking up electrical signals from a wire harness, said sub-harnesses branching off the wire harness, each of said sub-harnesses having a plurality of electric wires and a branch section for absorbing splices of the electrical wires, said branch section including:

a plurality of connecting terminals respectively crimped to an end portion of the electrical wire at the branch section of the sub-harness, each of said connecting terminals having a contact point elastic piece at an end portion thereof; and a plurality of blocks, the number of which corresponds to the number of sub-harnesses, capable of being engaged with and stack on each other, having a plurality of terminal accommodating chambers arranged in parallel for accommodating the connecting terminals, wherein when the plurality of blocks are stacked on each other, the contact point elastic piece of the connecting terminal of one sub-harness on one side contacts the corresponding contact point elastic piece of the connecting terminal of an adjacent sub-harness so that electrical continuity can be accomplished therebetween; and at least one block has a lateral opening for communicating an end of one terminal accommodating chamber with an end of the other terminal accommodating chamber, which is adjacent to one terminal accommodating chamber, and when the connecting terminal is accommodated in each terminal accommodating chamber under the condition that the contact point elastic piece of turned sideways, a vertex of one connecting terminal comes into contact with a base piece of the other connecting terminal via the lateral opening to absorb a splice between one distributing electrical wire and the other distributing electrical wire.

9. A splice absorbing structure according to claim 8, wherein the blocks defined by staking a plurality of the blocks are directly connected with other devices including a joint box so that electrical continuity can be accomplished.

10. A splice absorbing structure according to claim 9, wherein an uppermost block out of the stacked blocks serves as a cover of the longitudinal opening provided at the end of the terminal accommodating chamber, and said contact point elastic piece of the connecting terminal, which is accommodated in the terminal accommodating chamber, is a female terminal.

* * * * *